US012486856B2

(12) United States Patent
Duong et al.

(10) Patent No.: US 12,486,856 B2
(45) Date of Patent: Dec. 2, 2025

(54) DIFFUSER PIPE FOR AN AIRCRAFT PROPULSION SYSTEM

(71) Applicant: Pratt & Whitney Canada Corp., Longueuil (CA)

(72) Inventors: Hien Duong, Mississauga (CA); Jason Nichols, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/434,152

(22) Filed: Feb. 6, 2024

(65) Prior Publication Data

US 2025/0250989 A1 Aug. 7, 2025

(51) Int. Cl.
*F04D 29/44* (2006.01)
*F04D 17/10* (2006.01)

(52) U.S. Cl.
CPC ..... *F04D 29/441* (2013.01); *F04D 17/10* (2013.01)

(58) Field of Classification Search
CPC ..... F04D 29/441; F04D 29/444; F04D 29/44
See application file for complete search history.

(56) References Cited

U.S. PATENT DOCUMENTS 6,280,139 B1 * 8/2001 Romani ..... F04D 29/441 415/207
8,157,516 B2 4/2012 Chen
11,391,296 B1 7/2022 Duong
11,408,439 B2 * 8/2022 Higashimori ..... F04D 29/441
2013/0000308 A1 1/2013 Dovbush
2017/0114797 A1 4/2017 Duong
2020/0049076 A1 2/2020 Balike
2020/0378303 A1 12/2020 Nichols

FOREIGN PATENT DOCUMENTS

JP 05050511 B2 6/2008

OTHER PUBLICATIONS

EP Search Report for EP Patent Application No. 25156327.6 dated Jul. 10, 2025.

* cited by examiner

*Primary Examiner* — Michael L Sehn
(74) *Attorney, Agent, or Firm* — Getz Balich LLC

(57) ABSTRACT

A compressor diffuser for an aircraft propulsion system includes a plurality of diffuser pipes. Each diffuser pipe includes a pipe body. The pipe body extends between and to an inlet end and an outlet end. The pipe body includes a suction lateral wall and a pressure lateral wall. The pipe body further includes a transition body portion. The suction lateral wall and the pressure lateral wall extend between and to the inlet end and the outlet end to form a fluid passage. The fluid passage extends along a center position from a passage inlet at the inlet end to a passage outlet at the outlet end. The fluid passage has a cross-sectional area. The transition body portion is disposed at the outlet end. The transition body portion includes a diverging sub-portion and a converging sub-portion. The cross-sectional area increases in the diverging sub-portion. The cross-sectional area decreases in the converging sub-portion.

20 Claims, 6 Drawing Sheets

DIFFUSER PIPE FOR AN AIRCRAFT PROPULSION SYSTEM

TECHNICAL FIELD

This disclosure relates generally to aircraft propulsion systems and, more particularly, to diffuser pipes for aircraft propulsion systems.

BACKGROUND OF THE ART

Diffuser pipes are provided in certain gas turbine engines for diffusing fluid flow (e.g., air flow) received from an impeller of a centrifugal compressor and directing the flow to a downstream component, such as a combustor. Various diffuser pipe configurations are known in the art for gas turbine engines. While these known diffuser pipe configurations may be suitable for their intended purposes, there is always room in the art for improvement.

SUMMARY

It should be understood that any or all of the features or embodiments described herein can be used or combined in any combination with each and every other feature or embodiment described herein unless expressly noted otherwise.

According to an aspect of the present disclosure, a compressor diffuser for an aircraft propulsion system includes a plurality of diffuser pipes disposed circumferentially about an axis of the compressor diffuser. Each diffuser pipe of the plurality of diffuser pipes includes a pipe body. The pipe body extends between and to an inlet end and an outlet end. The pipe body includes a suction lateral wall, a pressure lateral wall, and opposing side walls. The opposing side walls extend between and connect the suction lateral wall and the pressure lateral wall. The pipe body further includes a transition body portion. The suction lateral wall, the pressure lateral wall, and the opposing side walls extend between and to the inlet end and the outlet end to form a fluid passage. The fluid passage extends along a center position from a passage inlet at the inlet end to a passage outlet at the outlet end. The fluid passage has a cross-sectional area. The transition body portion is disposed at the outlet end. The transition body portion includes a diverging sub-portion and a converging sub-portion. The cross-sectional area monotonically increases in the diverging sub-portion in a direction from the passage inlet to the passage outlet. The cross-sectional area monotonically decreases in the converging sub-portion in the direction from the passage inlet to the passage outlet.

In any of the aspects or embodiments described above and herein, the fluid passage may have a passage length. The passage length may extend between and to the suction lateral wall and the pressure lateral wall. The passage length may monotonically increases in the diverging sub-portion in the direction from the passage inlet to the passage outlet. The passage length may monotonically decreases in the converging sub-portion in the direction from the passage inlet to the passage outlet.

In any of the aspects or embodiments described above and herein, the transition body portion may form a turn of the pipe body. The suction lateral wall may form an inner wall of the turn. The pressure lateral wall may form an outer wall of the turn.

In any of the aspects or embodiments described above and herein, the pipe body may further include an inlet body portion. The inlet body portion may extend between and to the inlet end and the transition body portion. The cross-sectional area may monotonically increase in the inlet body portion in the direction from the passage inlet to the passage outlet.

In any of the aspects or embodiments described above and herein, the converging sub-portion may extend between and to the outlet end and the diverging sub-portion.

In any of the aspects or embodiments described above and herein, the diverging sub-portion and the converging sub-portion may form a bulge at the pressure lateral side.

In any of the aspects or embodiments described above and herein, the diverging sub-portion may form a maximum area of the cross-sectional area.

In any of the aspects or embodiments described above and herein, the converging sub-portion may form an exit area of the cross-sectional area at the passage outlet. An area ratio of the maximum area to the exit area may be between 1.05 and 1.15.

In any of the aspects or embodiments described above and herein, the pipe body may have a diffuser pipe length. The diffuser pipe length may extend between and to the inlet end and the outlet end. A portion of the diffuser pipe length that extends between the maximum area and the exit area may have a convergence length. The convergence length may be between five percent and thirty percent of the diffuser pipe length.

In any of the aspects or embodiments described above and herein, the diverging sub-portion may extend between and to the outlet end and the converging sub-portion.

In any of the aspects or embodiments described above and herein, the diverging sub-portion and the converging sub-portion may form a constriction at the suction lateral side.

In any of the aspects or embodiments described above and herein, the converging sub-portion may form a minimum area of the cross-sectional area within the transition body portion.

In any of the aspects or embodiments described above and herein, the converging sub-portion may form an initial area of cross-sectional area within the transition body portion at an upstream end of the transition body portion. An area ratio of the initial area to the minimum area may be between 1.05 and 1.25.

In any of the aspects or embodiments described above and herein, the pipe body may have a diffuser pipe length. The diffuser pipe length may extend between and to the inlet end and the outlet end. A portion of the diffuser pipe length that extends between the initial area and the minimum area may have a convergence length. The convergence length may be between five percent and forty percent of the diffuser pipe length.

According to another aspect of the present disclosure, a diffuser pipe for an aircraft propulsion system includes a pipe body. The pipe body extends between and to an inlet end and an outlet end. The pipe body includes a suction lateral wall, a pressure lateral wall, and opposing side walls. The opposing side walls extend between and connect the suction lateral wall and the pressure lateral wall. The pipe body further includes an inlet body portion and a transition body portion. The inlet body portion and the transition body portion form a fluid passage. The fluid passage extends through the pipe body from a passage inlet at the inlet end to a passage outlet at the outlet end. The fluid passage has a cross-sectional area. The inlet body portion extends between and to the inlet end and the transition body portion. The cross-sectional area monotonically increases in the inlet body portion in the direction from the passage inlet to the passage outlet. The transition body portion extends between and to the inlet body portion and the outlet end. The transition body portion forms a turn of the pipe body. The suction lateral wall forms an inner wall of the turn. The pressure lateral wall forms an outer wall of the turn. The transition body portion includes a diverging sub-portion and a converging sub-portion. The cross-sectional area monotonically increases in the diverging sub-portion in a direction from the passage inlet to the passage outlet. The cross-sectional area monotonically decreases in the converging sub-portion in the direction from the passage inlet to the passage outlet.

In any of the aspects or embodiments described above and herein, each of the suction lateral wall and the pressure lateral wall may have a concave shape. Each of the opposing side walls may extend in a straight direction between and to the suction lateral wall and the pressure lateral wall.

In any of the aspects or embodiments described above and herein, the fluid passage may have a passage length and a passage width. The passage length may extend between and to the suction lateral wall and the pressure lateral wall. The passage width may extend between and to the opposing side walls. The passage length may be greater than the passage width within the transition body portion.

In any of the aspects or embodiments described above and herein, the cross-sectional area may monotonically increase in the diffusion sub-portion at a greater rate than the cross-sectional area monotonically increases in the inlet body portion.

In any of the aspects or embodiments described above and herein, the diverging sub-portion and the converging sub-portion may forma bulge at the pressure lateral side.

In any of the aspects or embodiments described above and herein, the diverging sub-portion and the converging sub-portion may form a constriction at the suction lateral side.

The present disclosure, and all its aspects, embodiments and advantages associated therewith will become more readily apparent in view of the detailed description provided below, including the accompanying drawings.

DETAILED DESCRIPTION

Figure 1:
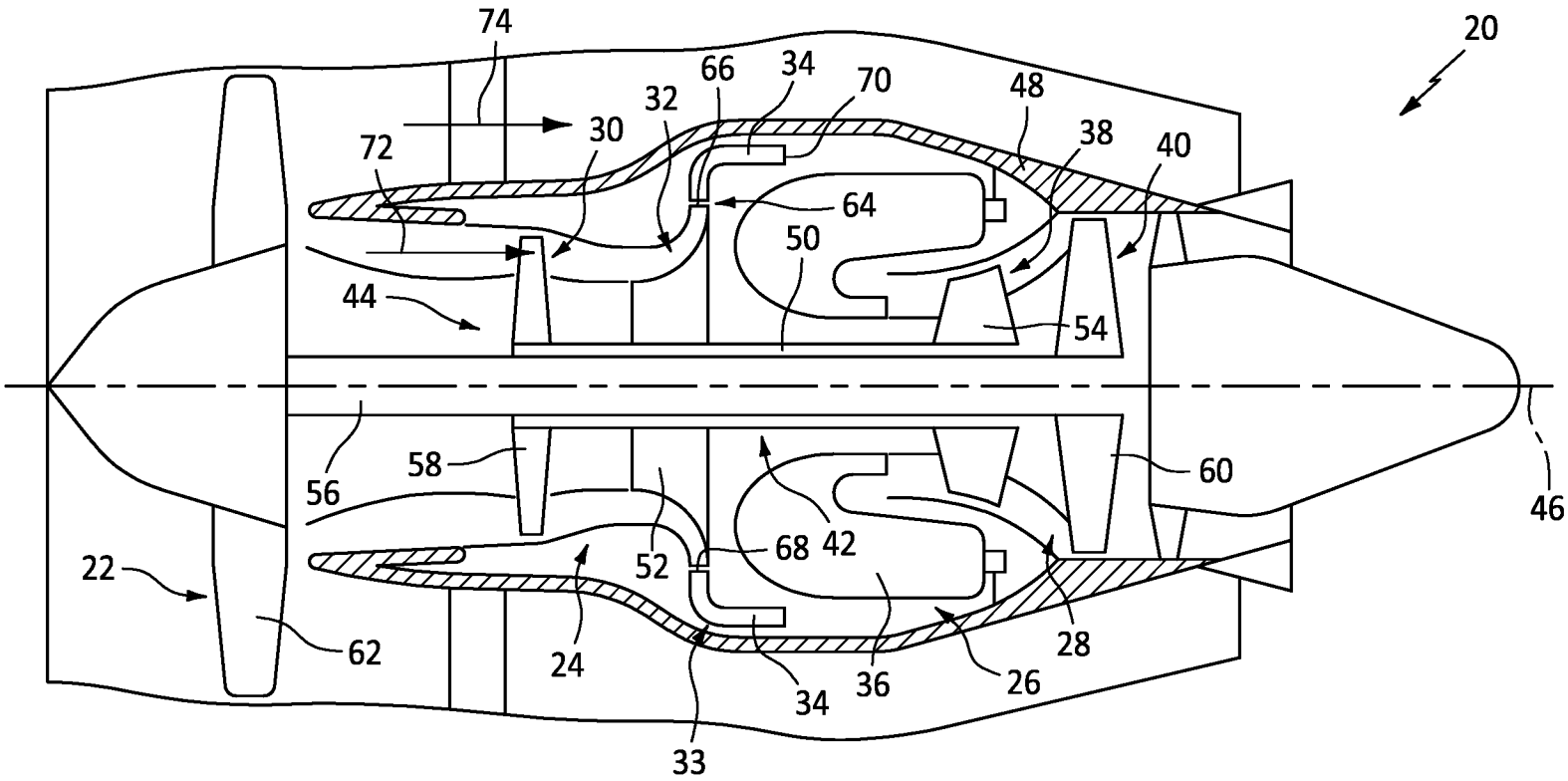
FIG. 1 schematically illustrates a cutaway, side view of a gas turbine engine for an aircraft propulsion system, in accordance with one or more embodiments of the present disclosure.

FIG. 1 schematically illustrates a gas turbine engine 20. The gas turbine engine 20 of FIG. 1 is a multi-spool turbofan gas turbine engine for an aircraft propulsion system. However, while the following description and accompanying drawings may refer to the turbofan gas turbine engine 20 of FIG. 1 as an example, it should be understood that aspects of the present disclosure may be equally applicable to other types of gas turbine engines including, but not limited to, a turboshaft gas turbine engine, a turboprop gas turbine engine, a turbojet gas turbine engine, a propfan gas turbine engine, or an open rotor gas turbine engine.

The gas turbine engine 20 of FIG. 1 includes a fan section 22, a compressor section 24, a combustor section 26, and a turbine section 28. The compressor section 24 of FIG. 1 includes a low-pressure compressor (LPC) 30, a high-pressure compressor (HPC) 32, and a compressor diffuser 33. The compressor diffuser 33 includes plurality of diffuser pipes 34. The combustor section 16 of FIG. 1 includes a combustor 36 (e.g., an annular combustor forming a combustion chamber). The turbine section 28 of FIG. 1 includes a high-pressure turbine (HPT) 38 and a low-pressure turbine (LPT) 40.

The gas turbine engine 20 sections 22, 24, 28 form a first rotational assembly 42 (e.g., a high-pressure spool) and a second rotational assembly 44 (e.g., a low-pressure spool) of the gas turbine engine 20. The first rotational assembly 42 and the second rotational assembly 44 are mounted for rotation about a rotational axis 46 (e.g., an axial centerline of the gas turbine engine 20) relative to an engine static structure 48 of the gas turbine engine 20. The engine static structure 48 may include one or more engine cases, cowlings, bearing assemblies, and/or other non-rotating structures configured to house and/or support components of the gas turbine engine 20 sections 22, 24, 26, 28.

The first rotational assembly 42 includes a first shaft 50, a bladed first compressor rotor 52 for the high-pressure compressor 32, and a bladed first turbine rotor 54 for the high-pressure turbine 38. The first shaft 50 interconnects the bladed first compressor rotor 52 and the bladed first turbine rotor 54.

The second rotational assembly 44 includes a second shaft 56, a bladed second compressor rotor 58 for the low-pressure compressor 30, and a bladed second turbine rotor 60 for the low-pressure turbine 40. The second shaft 56 interconnects the bladed second compressor rotor 58 and the bladed second turbine rotor 60. The second shaft 56 of FIG. 1 additionally interconnects the bladed second compressor rotor 58 and the bladed second turbine rotor 60 with a bladed fan rotor 62 for the fan section 22. The second shaft 56 may alternatively be coupled to the bladed fan rotor 62 (e.g., an input shaft of the bladed fan rotor 62) by a reduction gear assembly configured to drive the bladed fan rotor 62 at a reduced rotational speed relative to the second shaft 56.

The high-pressure compressor 32 includes a compressor exit 64 (e.g., an impeller exit). The compressor exit 64 includes a plurality of outlets 66. The outlets 66 may be circumferentially distributed about the rotational axis 46 to form the compressor exit 64. Each of the outlets 66 may be connected in fluid communication with a respective one of the diffuser pipes 34. Each of the outlets 66 may be oriented in an outer radial direction, relative to the rotational axis 46. For example, each of the outlets 66 may face away from (e.g., radially away from) the rotational axis 46 to direct compressed air from the high-pressure compressor 32 in a radially outward or substantially radially outward direction. Each of the diffuser pipes 34 extends between and to an inlet end 68 of the respective one of the diffuser pipes 34 and an outlet end 70 of the respective one of the diffuser pipes 34. The inlet end 68 is disposed at (e.g., on, adjacent, or proximate) a respective one of the outlets 66 to connect the respective diffuse pipe 34 in fluid communication with the respective one of the outlets 66. The inlet end 68 may be oriented facing in an inner radial direction, relative to the rotational axis 46. The outlet end 70 is disposed within the combustor section 26 upstream of the combustor 36. The outlet end 70 may be oriented facing in an axial direction (e.g., a downstream and/or aftward axial direction). While the compressor section 24 of FIG. 1 is described herein including a low-pressure compressor, a high-pressure compressor, and a plurality of diffuser pipes, the present disclosure is not limited to any particular number of compressors, compressor stages, or the like for the compressor section 24.

In operation of the gas turbine engine 20 of FIG. 1, ambient air is directed through the fan section 22 and into a core flow path 72 and a bypass flow path 74 by rotation of the bladed fan rotor 62. Airflow along the core flow path 72 is compressed by the low-pressure compressor 30 and the high-pressure compressor 32 and directed from the compressor exit 64 to the combustor section 26 by the diffuser pipes 34. The diffuser pipes 34 of FIG. 1 redirect the compressed air along the core flow path 72 from an outer radial flow direction at (e.g., on, adjacent, or proximate) the compressor exit 64 to an axial flow direction at (e.g., on, adjacent, or proximate) the combustor section 26. For example, the diffuser pipes 34 may turn the compressed air along the core flow path 72 by approximately ninety degrees (90°) from the inlet end 68 to the outlet end 70. The compressed air from the diffuser pipes 34 is mixed and burned with fuel in the combustor 36 (e.g., the combustion chamber), and then directed through the high-pressure turbine 38 and the low-pressure turbine 40. The bladed first turbine rotor 54 and the bladed second turbine rotor 60 rotationally drive the first rotational assembly 42 and the second rotational assembly 44, respectively, in response to the combustion gas flow through the high-pressure turbine 38 and the low-pressure turbine 40. The first shaft 50 and the second shaft 56 of FIG. 1 are concentric and rotate about the rotational axis 46. The present disclosure, however, is not limited to concentric configurations of the first shaft 50 and the second shaft 56 and the first shaft 50 and the second shaft 56 may alternatively be configured for rotation about discrete rotational axes.

Figure 2:
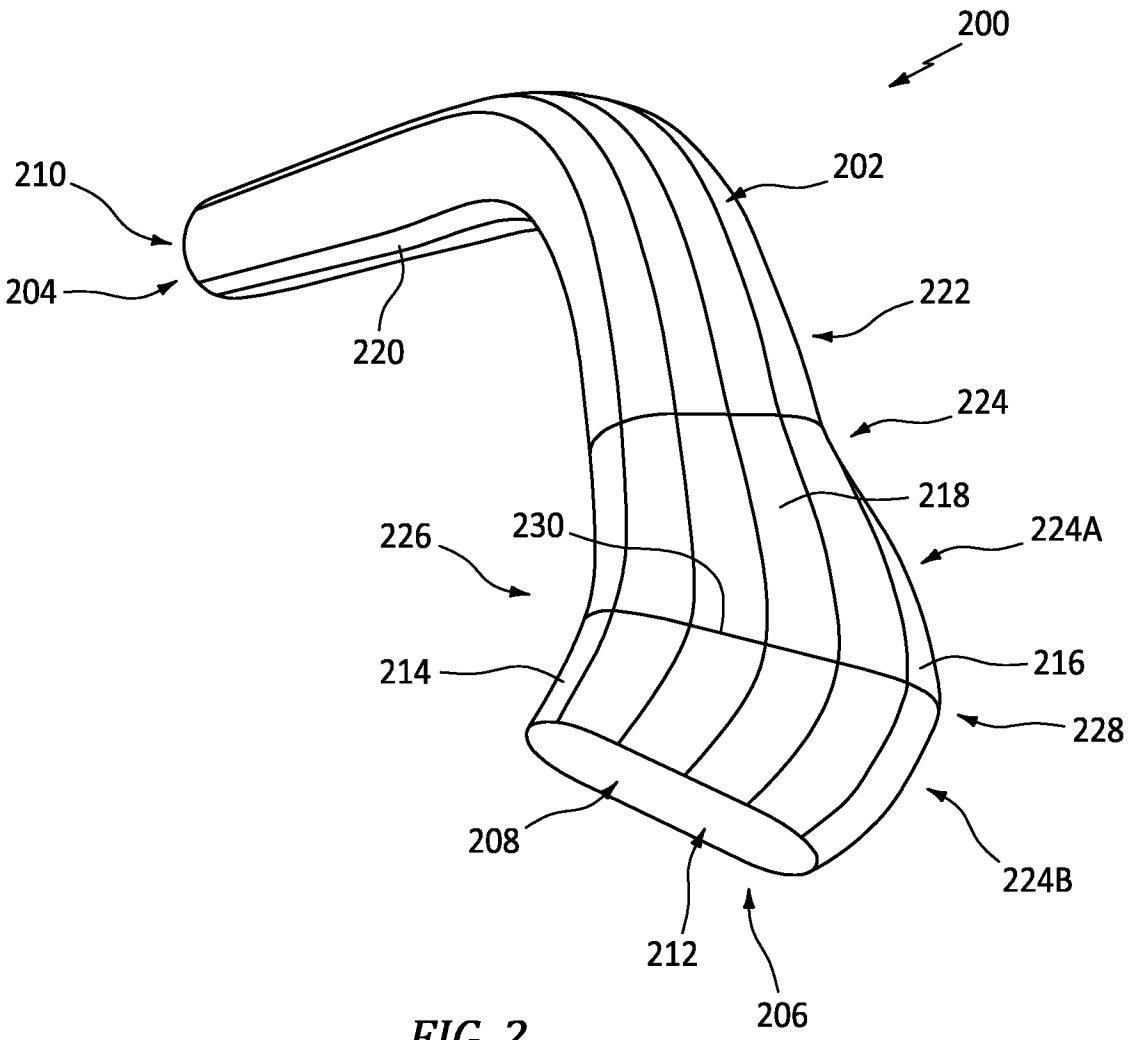
FIG. 2 illustrates a perspective view of a diffuser pipe for a gas turbine engine, in accordance with one or more embodiments of the present disclosure.

FIG. 2 illustrates a perspective view of a diffuser pipe 200. The diffuser pipe 200 includes a pipe body 202 extending between and to an inlet end 204 of the diffuser pipe 200 and an outlet end 206 of the diffuser pipe 200. The pipe body 202 surrounds and forms a fluid passage 208 extending between and to the inlet end 204 and the outlet end 206. The fluid passage 208 includes a passage inlet 210 and a passage outlet 212. The passage inlet 210 is disposed at (e.g., on, adjacent, or proximate) the inlet end 204. The passage outlet 212 is disposed at (e.g., on, adjacent, or proximate) the outlet end 206. The diffuser pipe 200 may be used, for example, for one, more than one, or all of the diffuser pipes 34 of FIG. 1. For example, the diffuse pipe 200 may be mounted with the inlet end 204 at (e.g., on, adjacent, or proximate) a respective one of the outlets 66 and the outlet end 206 within the combustor section 26 (see FIG. 1). However, the diffuser pipe 200 of the present disclosure is not limited to the foregoing exemplary gas turbine engine 20 configuration of FIG. 1.

Figure 3:
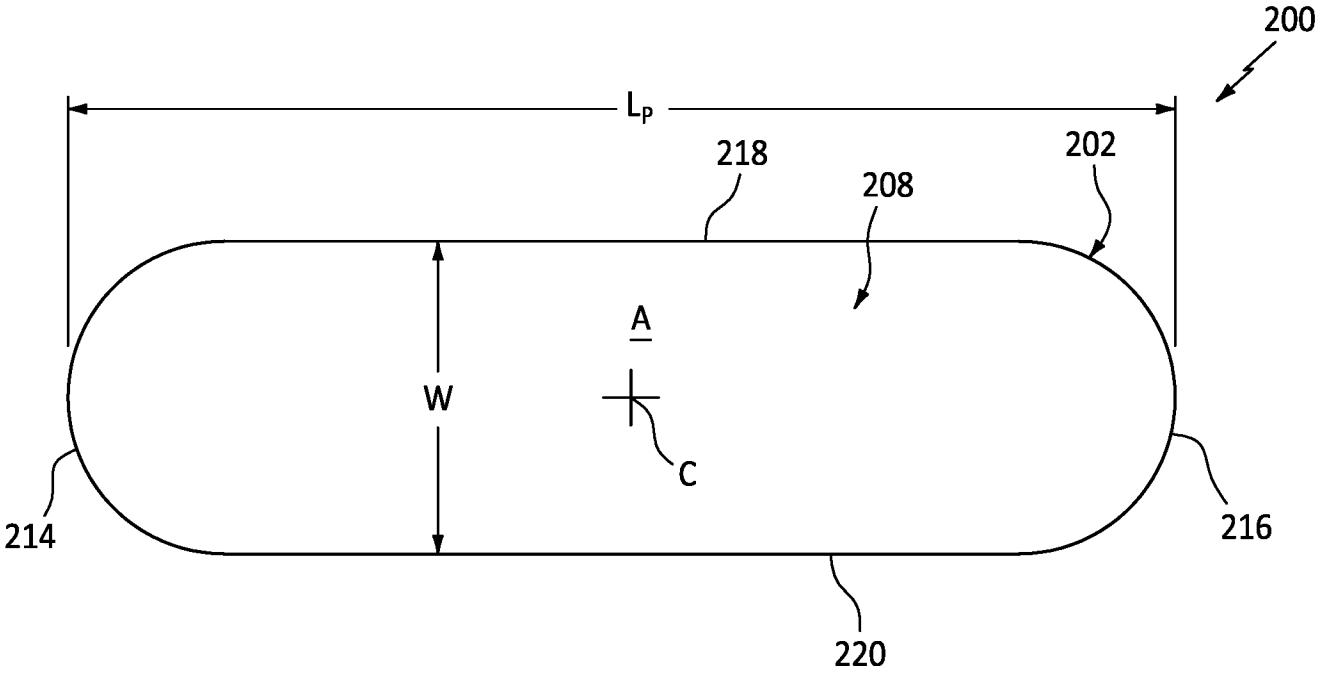
FIG. 3 illustrates a cutaway view of the diffuser pipe of FIG. 2, in accordance with one or more embodiments of the present disclosure.

FIG. 3 illustrates a cross-sectional view of the diffuser pipe 200 showing the pipe body 202 and the fluid passage 208. The pipe body 202 includes a suction lateral wall 214, a pressure lateral wall 216, a first side wall 218, and a second side wall 220 (e.g., opposing side walls 218, 220). The suction lateral wall 214, the pressure lateral wall 216, the first side wall 218, and the second side wall 220 extend between and to the inlet end 204 and the outlet end 206. The suction lateral wall 214, the pressure lateral wall 216, the first side wall 218, and the second side wall 220 surround and form the fluid passage 208 from the inlet end 204 to the outlet end 206. Each of the first side wall 218 and the second side wall 220 extends between and connects the suction lateral wall 214 and the pressure lateral wall 216. The suction lateral wall 214 and the pressure lateral wall 216 may have a curved shape. For example, the suction lateral wall 214 and the pressure lateral wall 216 may have a concave shape formed in a direction from the first side wall 218 to the second side wall 220. This concave shape may face and form the fluid passage 208. The first side wall 218 and the second side wall 220 may extend in a straight direction or a substantially straight direction from the suction lateral wall 214 to the pressure lateral wall 216. The present disclosure, however, is not limited to the foregoing exemplary configuration of the suction lateral wall 214, the pressure lateral wall 216, the first side wall 218, and the second side wall 220. Moreover, the sizes and shapes of the suction lateral wall 214, the pressure lateral wall 216, the first side wall 218, and the second side wall 220 may vary along the pipe body 202 from the inlet end 204 to the outlet end 206, as will be discussed in further detail.

The fluid passage 208 has a center position C, which center position C extends within a center of the fluid passage 208 between and to the passage inlet 210 and the passage outlet 212. The pipe body 202 has a diffuser pipe length $L_D$ (see FIGS. 4 and 6) which extends from the inlet end 204 to the outlet end 206 along the center position C. The fluid passage 208 formed by the pipe body 202 has a length $L_P$ and a width W. The length $L_P$ and the width W may be understood relative to a plane extending orthogonal to a general direction of fluid flow through the diffuser pipe 200 (e.g., from the passage inlet 210 to the passage outlet 212). The length $L_P$ extends between and to the suction lateral wall 214 and the pressure lateral wall 216. For example, the length $L_P$ may extend between and to extremum points of the suction lateral wall 214 and the pressure lateral wall 216. The width W extends between and to the first side wall 218 and the second side wall 220. The width W may be orthogonal to the length $L_P$. As shown in FIG. 3, the length $L_P$ may be greater than the width W. The fluid passage 208 has a cross-sectional area (hereinafter an "area A) along the plane containing the length $L_P$ and the width W.

The pipe body 202 includes an inlet body portion 222 and a transition body portion 224. The inlet body portion 222 extends between and to the inlet end 204 and the transition body portion 224. The inlet body portion 222 includes the suction lateral wall 214, the pressure lateral wall 216, the first side wall 218, and the second side wall 220 between the inlet end 204 and the transition body portion 224. The transition body portion 224 extends between and to the inlet body portion 222 and the outlet end 206. The transition body portion 224 includes the suction lateral wall 214, the pressure lateral wall 216, the first side wall 218, and the second side wall 220 between the inlet body portion 222 and the outlet end 206.

Within the inlet body portion 222, the area A of the fluid passage 208 increases monotonically in an upstream-to-downstream direction. As used herein with respect to the diffuser pipe 200, the terms "upstream" and "downstream" refer to the general direction of fluid flow through the fluid passage 208 (e.g., from the passage inlet 210 to the passage outlet 212).

The transition body portion 224 is characterized by a deviation and shape, size, and orientation relative to the inlet body portion 222. The transition body portion 224 forms a turn 226 of the diffuser pipe 202, and hence the fluid passage 208, to turn the fluid flow within the fluid passage 208. For example, the transition body portion 224 may form the turn 226 in a direction toward the suction lateral wall 214 and away from the pressure lateral wall 216. Within the transition body portion 224, the suction lateral wall 214 may curve away from the center position C, in the upstream-to-downstream direction, to form the turn 226. For example, the suction lateral wall 214 may have a convex shape in the upstream-to-downstream direction, with the convex shape facing and forming the fluid passage 208. Within the transition body portion 224, the pressure lateral wall 216 may curve toward the center position C, in the upstream-to-downstream direction, to form the turn 226. For example, the pressure lateral wall 216 may have a concave shape in the upstream-to-downstream direction, with the concave shape facing and forming the fluid passage 208. In other words, the suction lateral wall 214 may form an inner wall of the turn 226 and the pressure lateral wall 216 may form an outer wall of the turn 226. The turn 226 of the diffuser pipe 202 may facilitate the removal of flow swirl from the fluid flowing through the fluid passage 208 (e.g., from the high-pressure compressor 32) and axial straightening of the fluid flow into the combustor section 26 (see FIG. 1).

The transition body portion 224 of FIG. 2 includes a diverging sub-portion 224A and a converging sub-portion 224B. The diverging sub-portion 224A extends between and to the inlet body portion 222 and the converging sub-portion 224B. The diverging sub-portion 224A includes the suction lateral wall 214, the pressure lateral wall 216, the first side wall 218, and the second side wall 220 between the inlet body portion 222 and the converging sub-portion 224B. The converging sub-portion 224B extends between and to the diverging sub-portion 224A and the outlet end 206. The converging sub-portion 224B includes the suction lateral wall 214, the pressure lateral wall 216, the first side wall 218, and the second side wall 220 between the diverging sub-portion 224A and the outlet end 206.

Within the diverging sub-portion 224A, the area A of the fluid passage 208 increases monotonically in the upstream-to-downstream direction. For example, the area A of the fluid passage 208 within the diverging sub-portion 224A may increase, in the upstream-to-downstream direction, by a greater amount per unit length of the length $L_D$ than in the inlet body portion 224. Within the diverging sub-portion 224A, the length $L_P$ may similarly increase monotonically in the upstream-to-downstream direction, thereby contributing to all or a substantial portion of the increase in area A within the diverging sub-portion 224A. The width W within the diverging sub-portion 224A may remain constant or substantially constant, however, the present disclosure is not limited to any particular width W or change thereof within the diverging sub-portion 224A. The diverging sub-portion 224A may form a bulge 228 at (e.g., on, adjacent, or proximate) the pressure lateral wall 216. For example, the bulge 228 may be disposed at (e.g., on, adjacent, or proximate) an interface 230 between the diverging sub-portion 224A and the converging sub-portion 224B. For example, the bulge 228 may be formed by a localized divergence in a shape of the pipe body 202 at (e.g., on, adjacent, or proximate) the pressure lateral wall 216 which accounts for all or substantially all of the increase in area A (e.g., the increase in length $L_P$) through the diverging sub-portion 224A in the upstream-to-downstream direction.

Within the converging sub-portion 224B, the area A of the fluid passage 208 decreases monotonically in the upstream-to-downstream direction. Within the converging sub-portion 224B, the length $L_P$ may similarly decrease monotonically in the upstream-to-downstream direction, thereby contributing to all or a substantial portion of the decrease in area A within the converging sub-portion 224B. The width W within the converging sub-portion 224B may remain constant or substantially constant, however, the present disclosure is not limited to any particular width W or change thereof within the converging sub-portion 224B. The converging sub-portion 224B may further form the bulge 228 at (e.g., on, adjacent, or proximate) the pressure lateral wall 216 (e.g., at the interface 230). For example, the bulge 228 may be formed by a localized divergence in a shape of the pipe body 202 at (e.g., on, adjacent, or proximate) the pressure lateral wall 216 which accounts for all or substantially all of the decrease in area A (e.g., the decrease in length $L_P$) through the converging sub-portion 224B in the upstream-to-downstream direction.

Figure 4:
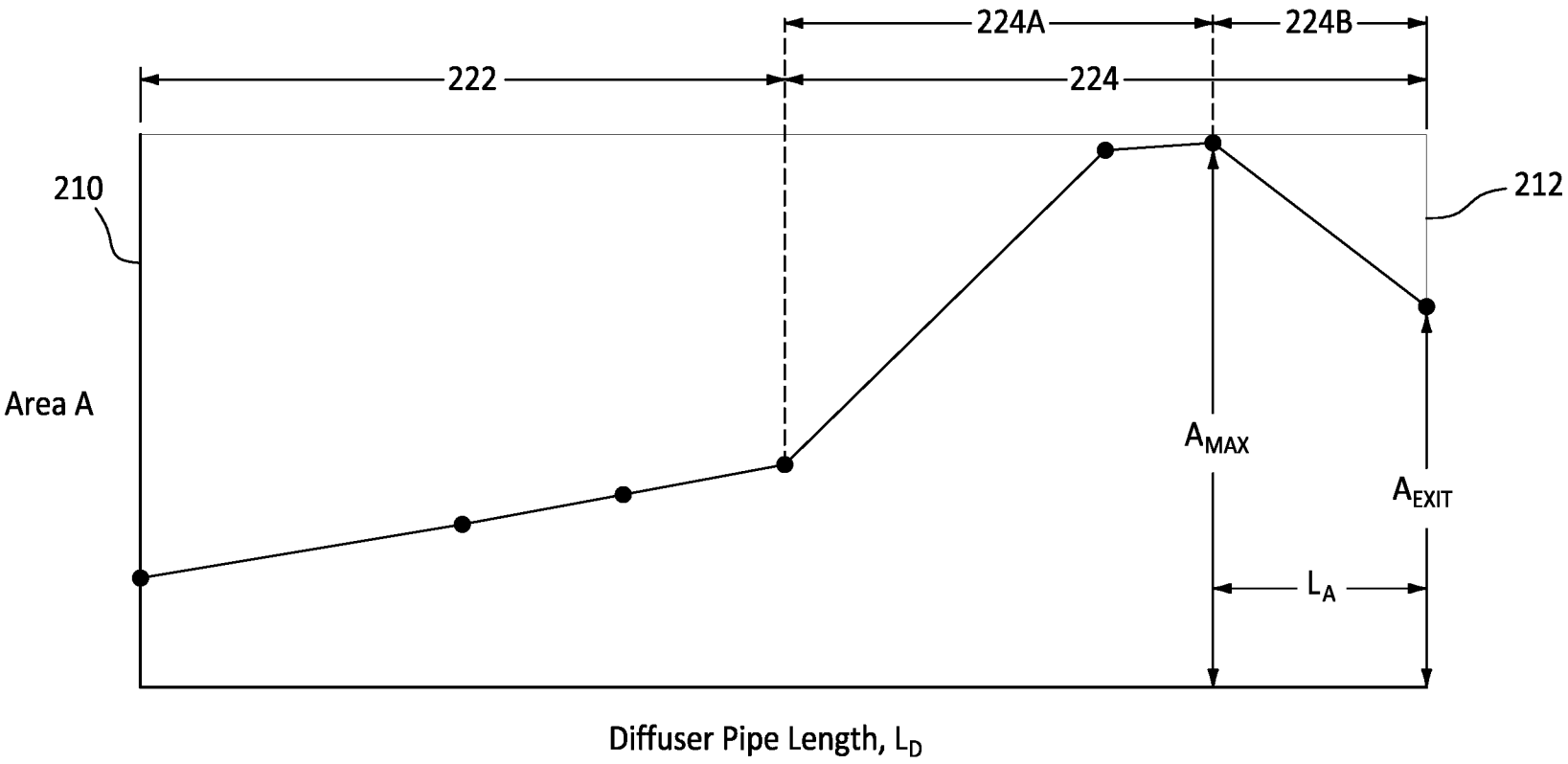
FIG. 4 graphically illustrates an area of the diffuser pipe of FIG. 2 along a length of the diffuser pipe, in accordance with one or more embodiments of the present disclosure.

FIG. 4 graphically illustrates the area A of the fluid passage 208 at a plurality of points along the length $L_D$ of the diffuser pipe 200 between and to the inlet end 204 and the outlet end 206. As shown in FIG. 4, the area A of the fluid passage 208 may increase (e.g., monotonically increase) through the inlet body portion 222 in the upstream-to-downstream direction from the passage inlet 210 to the passage outlet 212. Similarly, the area A of the fluid passage 208 may increase (e.g., monotonically increase) through the diverging sub-portion 224A in the upstream-to-downstream direction, for example, at a greater rate than within the inlet body portion 222. The diverging sub-portion 224A may include and form a maximum area $A_{MAX}$ of the fluid passage 208. For example, the maximum area $A_{MAX}$ may be located within the diverging sub-portion 224A and/or at the interface 230. The area A of the fluid passage 208 may decrease (e.g., monotonically decrease) through the converging sub-portion 224A in the upstream-to-downstream direction. The converging sub-portion 224B may include and form an exit area $A_{EXIT}$ at (e.g., on, adjacent, or proximate) the passage outlet 212. The transition body portion 224 may form an area ratio of the maximum area $A_{MAX}$ to the exit area $A_{EXIT}$ of between 1.05 and 1.15. As shown in FIG. 4, the transition body portion 224 of FIG. 2 has a convergence length LA which is a portion of the diffuser pipe length $L_D$ along the center position C from the maximum area $A_{MAX}$ to the exit area $A_{EXIT}$. The convergence length LA may be between five percent (5%) and thirty percent (30%) of the diffuser pipe length $L_D$.

In operation (e.g., of the gas turbine engine 20), the deceleration and diffusion of fluid within the diverging sub-portion 224A followed by acceleration in the converging sub-portion 224B facilitates improved fluid flow homogeneity at the passage outlet 212. In particular, the shape and area A transition through the transition body portion 224 may form a greater pressure gradient across the fluid passage 208, from the pressure lateral wall 216 to the suction lateral wall 214, thereby directly higher momentum fluid flow proximate the pressure lateral wall 216 through a lower momentum fluid flow region proximate the suction lateral wall 214. Accordingly, the present disclosure facilitates reduced fluid flow losses within the diffuser pipe 200 and, for example, improved gas turbine engine (e.g., the gas turbine engine 20; see FIG. 1) combustion and efficiency. The outlet end 206 (e.g., the exit area $A_{EXIT}$) may also facilitate use of the diffuser pipe 200 with existing gas turbine engine components (e.g., gas generator case, the combustor liner, etc.) without the need for modifying the geometry of these components.

Figure 5:
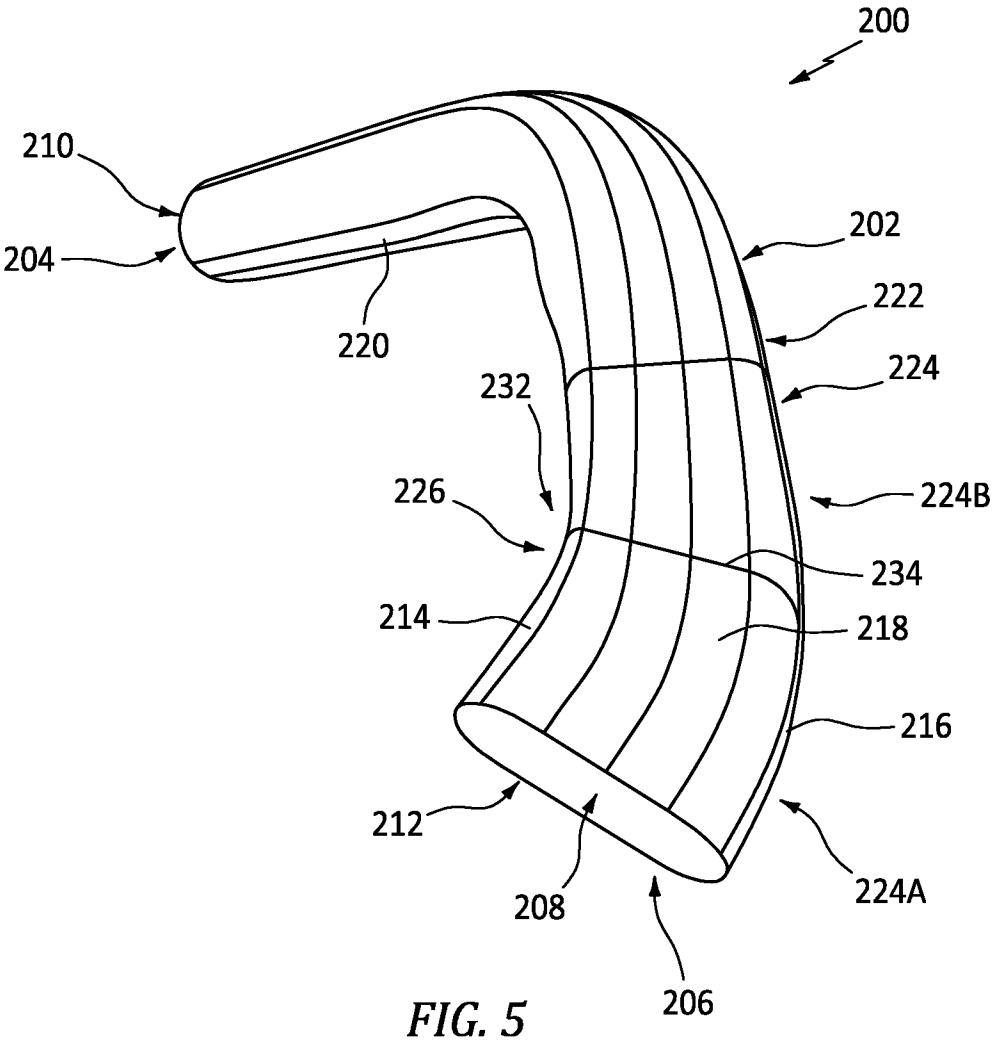
FIG. 5 illustrates a perspective view of another diffuser pipe for a gas turbine engine, in accordance with one or more embodiments of the present disclosure.

Referring now to FIG. 5, in some embodiments, the diffuser pipe 200 may alternatively be configured with the diverging sub-portion 224A and the converging sub-portion 224B arranged to sequentially accelerate and decelerate fluid through the fluid passage 208 in the upstream-to-downstream direction. The diffuser pipe body 202 of FIG. 5 includes the inlet body portion 222 and the transition body portion 224. The transition body portion 224 includes the diverging sub-portion 224A and the converging sub-portion 224B. The converging sub-portion 224B of FIG. 5 extends between and to the inlet body portion 222 and the diverging sub-portion 224A. The diverging sub-portion 224A of FIG. 5 extends between and to the converging sub-portion 224B and the outlet end 206.

The diverging sub-portion 224A may form a constriction 232 at (e.g., on, adjacent, or proximate) the suction lateral wall 214. For example, the constriction 232 may be disposed at (e.g., on, adjacent, or proximate) an interface 234 between the diverging sub-portion 224A and the converging sub-portion 224B. For example, the constriction 232 may be formed by a localized divergence in a shape of the pipe body 202 at (e.g., on, adjacent, or proximate) the suction lateral wall 214 which accounts for all or substantially all of a decrease in area A (e.g., a decrease in length $L_P$) through the converging sub-portion 224B in the upstream-to-downstream direction (see FIG. 3).

Figure 6:
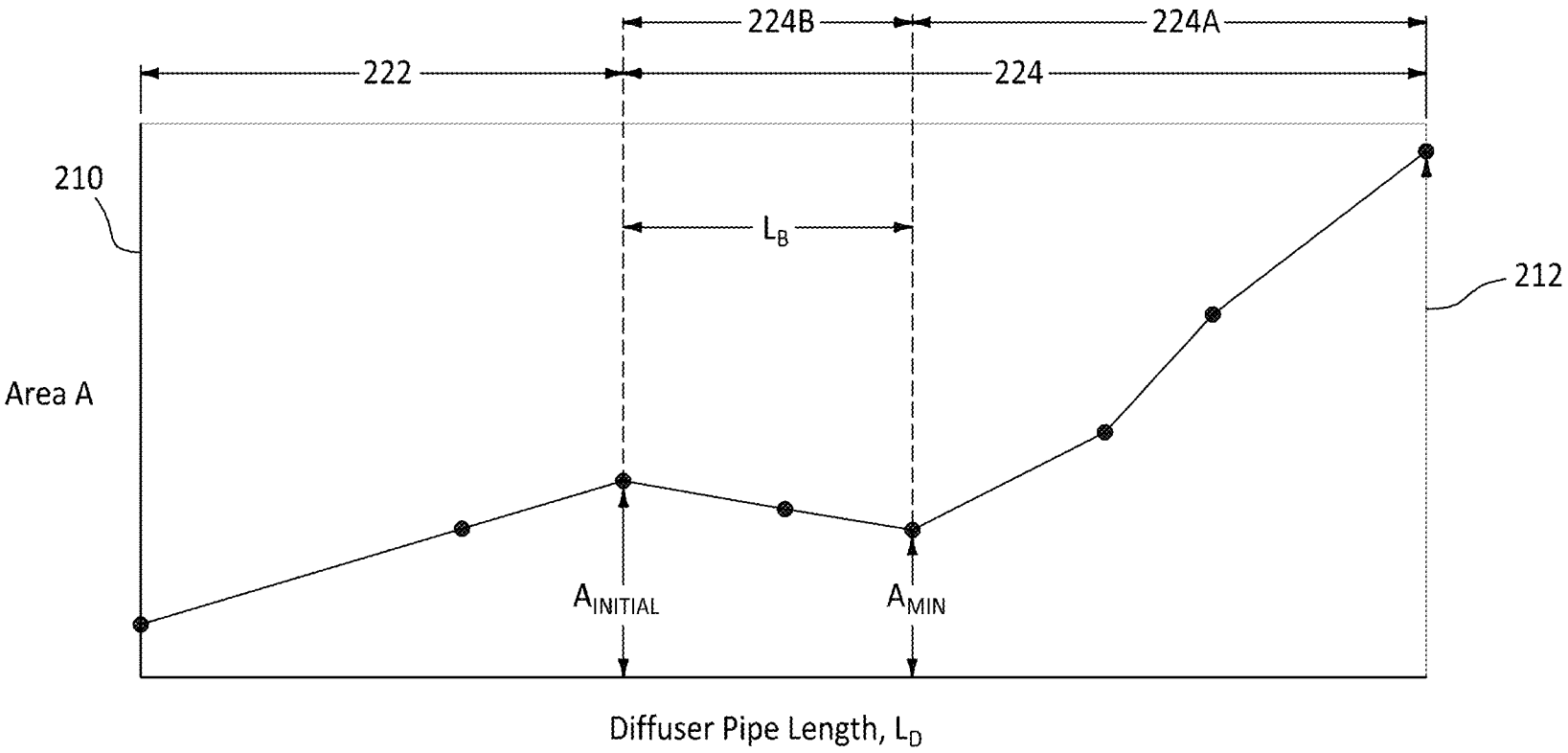
FIG. 6 graphically illustrates an area of the diffuser pipe of FIG. 5 along a length of the diffuser pipe, in accordance with one or more embodiments of the present disclosure.

FIG. 6 graphically illustrates the area A of the fluid passage 208 at a plurality of points along the length $L_D$ of the diffuser pipe 200 of FIG. 5 between and to the inlet end 204 and the outlet end 206. As shown in FIG. 6, the area A of the fluid passage 208 may increase (e.g., monotonically increase) through the inlet body portion 222 in the upstream-to-downstream direction from the passage inlet 210 to the passage outlet 212. The area A of the fluid passage 208 may subsequently decrease (e.g., monotonically decrease) through the converging sub-portion 224B in the upstream-to-downstream direction. The converging sub-portion 224A may include and form an initial area $A_{INITIAL}$ and a minimum area $A_{MIN}$ of the fluid passage 208 within the transition body portion 224. For example, the initial area $A_{INITIAL}$ may be formed by an upstream end of the transition body portion 224 (e.g., the converging sub-portion 224B) and the minimum area $A_{MIN}$ may be formed by a downstream end of the converging sub-portion 224B. The transition body portion 224 may form an area ratio of the initial area $A_{INITIAL}$ to the minimum area $A_{MIN}$ of between 1.05 and 1.25. As shown in FIG. 6, the transition body portion 224 of FIG. 5 has a convergence length $L_B$ which is a portion of the diffuser pipe length $L_D$ along the center position C from the initial area $A_{INITIAL}$ to the minimum area $A_{MIN}$. The convergence length $L_B$ may be between five percent (5%) and forty percent (40%) of the diffuser pipe length $L_D$.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected, or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements.

The invention claimed is:

1. A compressor diffuser for an aircraft propulsion system, the compressor diffuser comprising:

a plurality of diffuser pipes disposed circumferentially about an axis of the compressor diffuser, each diffuser pipe of the plurality of diffuser pipes includes a pipe body, the pipe body extends between and to an inlet end and an outlet end, the pipe body includes a suction lateral wall, a pressure lateral wall, and opposing side walls, the opposing side walls extend between and connect the suction lateral wall and the pressure lateral wall, the pipe body further includes a transition body portion, the suction lateral wall, the pressure lateral wall, and the opposing side walls extend between and to the inlet end and the outlet end to form a fluid passage, the fluid passage extends along a center position from a passage inlet at the inlet end to a passage outlet at the outlet end, the fluid passage has a cross-sectional area, the transition body portion is disposed at the outlet end, the transition body portion includes a diverging sub-portion and a converging sub-portion, the cross-sectional area monotonically increases in the diverging sub-portion in a direction from the passage inlet to the passage outlet, and the cross-sectional area monotonically decreases in the converging sub-portion in the direction from the passage inlet to the passage outlet, and the transition body portion forms a turn of the pipe body, the suction lateral wall forms an inner wall of the turn, and the pressure lateral wall forms an outer wall of the turn.

2. The compressor diffuser of claim 1, wherein the fluid passage has a passage length, the passage length extends between and to the suction lateral wall and the pressure lateral wall, the passage length monotonically increases in the diverging sub-portion in the direction from the passage inlet to the passage outlet, and the passage length monotonically decreases in the converging sub-portion in the direction from the passage inlet to the passage outlet.

3. The compressor diffuser of claim 1, wherein the pipe body further includes an inlet body portion, the inlet body portion extends between and to the inlet end and the transition body portion, and the cross-sectional area monotonically increases in the inlet body portion in the direction from the passage inlet to the passage outlet.

4. The compressor diffuser of claim 1, wherein the converging sub-portion extends between and to the outlet end and the diverging sub-portion.

5. The compressor diffuser of claim 4, wherein the diverging sub-portion and the converging sub-portion form a bulge at the pressure lateral side.

6. The compressor diffuser of claim 4, wherein the diverging sub-portion forms a maximum area of the cross-sectional area.

7. The compressor diffuser of claim 6, wherein the converging sub-portion forms an exit area of the cross-sectional area at the passage outlet, and an area ratio of the maximum area to the exit area is between 1.05 and 1.15.

8. The compressor diffuser of claim 7, wherein the pipe body has a diffuser pipe length, the diffuser pipe length extends between and to the inlet end and the outlet end, a portion of the diffuser pipe length that extends between the maximum area and the exit area has a convergence length, and the convergence length is between five percent and thirty percent of the diffuser pipe length.

9. The compressor diffuser of claim 1, wherein the diverging sub-portion extends between and to the outlet end and the converging sub-portion.

10. The compressor diffuser of claim 9, wherein the diverging sub-portion and the converging sub-portion form a constriction at the suction lateral side.

11. The compressor diffuser of claim 9, wherein the converging sub-portion forms a minimum area of the cross-sectional area within the transition body portion.

12. The compressor diffuser of claim 11, wherein the converging sub-portion forms an initial area of cross-sectional area within the transition body portion at an upstream end of the transition body portion, and an area ratio of the initial area to the minimum area is between 1.05 and 1.25.

13. The compressor diffuser of claim 12, wherein the pipe body has a diffuser pipe length, the diffuser pipe length extends between and to the inlet end and the outlet end, a portion of the diffuser pipe length that extends between the initial area and the minimum area has a convergence length, and the convergence length is between five percent and forty percent of the diffuser pipe length.

14. A diffuser pipe for an aircraft propulsion system, the diffuser pipe comprising:

a pipe body, the pipe body extends between and to an inlet end and an outlet end, the pipe body includes a suction lateral wall, a pressure lateral wall, and opposing side walls, the opposing side walls extend between and connect the suction lateral wall and the pressure lateral wall, the pipe body further includes an inlet body portion and a transition body portion, the inlet body portion and the transition body portion form a fluid passage, the fluid passage extends through the pipe body from a passage inlet at the inlet end to a passage outlet at the outlet end, the fluid passage has a cross-sectional area, the inlet body portion extends between and to the inlet end and the transition body portion, and the cross-sectional area monotonically increases in the inlet body portion in the direction from the passage inlet to the passage outlet, the transition body portion extends between and to the inlet body portion and the outlet end, the transition body portion forms a turn of the pipe body, the suction lateral wall forms an inner wall of the turn, and the pressure lateral wall forms an outer wall of the turn, the transition body portion includes a diverging sub-portion and a converging sub-portion, the cross-sectional area monotonically increases in the diverging sub-portion in a direction from the passage inlet to the passage outlet, the cross-sectional area monotonically decreases in the converging sub-portion in the direction from the passage inlet to the passage outlet.

15. The diffuser pipe of claim 14, wherein:

each of the suction lateral wall and the pressure lateral wall has a concave shape; and each of the opposing side walls extends in a straight direction between and to the suction lateral wall and the pressure lateral wall.

16. The diffuser pipe of claim 15, wherein the fluid passage has a passage length and a passage width, the passage length extends between and to the suction lateral wall and the pressure lateral wall, the passage width extends between and to the opposing side walls, and the passage length is greater than the passage width within the transition body portion.

17. The diffuser pipe of claim 14, wherein the cross-sectional area monotonically increases in the diverging sub-portion at a greater rate than the cross-sectional area monotonically increases in the inlet body portion.

18. The diffuser pipe of claim 14, wherein the diverging sub-portion and the converging sub-portion form a bulge at the pressure lateral side.

19. The diffuser pipe of claim 14, wherein the diverging sub-portion and the converging sub-portion form a constriction at the suction lateral side.

20. A compressor diffuser for an aircraft propulsion system, the compressor diffuser comprising:

a plurality of diffuser pipes disposed circumferentially about an axis of the compressor diffuser, each diffuser pipe of the plurality of diffuser pipes includes a pipe body, the pipe body extends between and to an inlet end and an outlet end, the pipe body includes a suction lateral wall, a pressure lateral wall, and opposing side walls, the opposing side walls extend between and connect the suction lateral wall and the pressure lateral wall, the pipe body further includes a transition body portion, the suction lateral wall, the pressure lateral wall, and the opposing side walls extend between and to the inlet end and the outlet end to form a fluid passage, the fluid passage extends along a center position from a passage inlet at the inlet end to a passage outlet at the outlet end, the fluid passage has a cross-sectional area, the transition body portion is disposed at the outlet end, the transition body portion includes a diverging sub-portion and a converging sub-portion, the cross-sectional area monotonically increases in the diverging sub-portion in a direction from the passage inlet to the passage outlet, and the cross-sectional area monotonically decreases in the converging sub-portion in the direction from the passage inlet to the passage outlet, and the diverging sub-portion extends between and to the outlet end and the converging sub-portion.

* * * * *